US006231124B1

(12) United States Patent
Goldstein

(10) Patent No.: US 6,231,124 B1
(45) Date of Patent: May 15, 2001

(54) MULTI-FUNCTIONAL CAFE CHAIR

(75) Inventor: Thomas Goldstein, 130 W. 67th St. Suite 8M, New York, NY (US) 10023

(73) Assignee: Thomas Goldstein, New York, NY (US)

( * ) Notice: Subject to any disclaimer, the term of this patent is extended or adjusted under 35 U.S.C. 154(b) by 131 days.

(21) Appl. No.: 08/880,760

(22) Filed: Jun. 23, 1997

(51) Int. Cl.[7] ..... A47C 1/12

(52) U.S. Cl. ..... 297/446.2; 297/440.22; 297/452.29

(58) Field of Search ..... 297/445.1, 446.1, 297/446.2, 447.4, 452.29, 440.22, 440.1; 248/188.91

(56) References Cited

U.S. PATENT DOCUMENTS

| | | | | |
|---|---|---|---|---|
| D. 148,504 | * | 1/1948 | Vetter | 297/446.2 X |
| 1,011,026 | * | 12/1911 | Carpenter | 297/452.29 |
| 2,162,060 | * | 6/1939 | Churchill | 297/452.29 X |
| 2,613,728 | * | 10/1952 | Loibl, Sr. | 297/440.22 X |
| 2,789,631 | * | 4/1957 | Vosbikian et al. | 248/188.91 |
| 3,485,527 | * | 12/1969 | Barghout | 297/440.13 X |
| 3,825,302 | * | 7/1974 | Kurtz | 297/440.22 |
| 4,520,515 | * | 6/1985 | Hatala | 297/440.22 X |
| 4,676,553 | * | 6/1987 | Lange | 297/440.22 X |
| 4,850,647 | * | 7/1989 | Engel | 297/446.1 |
| 5,382,080 | * | 1/1995 | Gamberini et al. | 297/440.13 X |
| 5,474,356 | * | 12/1995 | Johnson | 297/163 X |
| 5,702,158 | * | 12/1997 | Mengshoel et al. | 297/445.1 |

* cited by examiner

*Primary Examiner*—Peter M. Cuomo
*Assistant Examiner*—Stephen Vu
(74) *Attorney, Agent, or Firm*—Hopgood, Calimafde Judlowe & Mondolino

(57) ABSTRACT

A readily movable cafe chair that is multi-functional and therefore useable by its seated occupant in various ways. The chair includes a back section formed by a sculptured panel defining a flat figure whose head merges with a body region having outwardly swelling hips from which extend widely spaced legs between which is a crotch zone. Joined to the back section is a front section having a lobe-shaped seat whose front end is supported by a pair of front legs which are spaced from the rear legs and are coupled thereto by a fork. The arcuate rear end of the seat is attached at its apex to the crotch zone of the back section. The sides of the lobe-shaped seat curve inwardly toward the crotch zone to create free spaces adjacent the rear legs of the chair. Thus the occupant may seat himself in a direct mode facing forwardly, or in a reverse mode facing rearwardly. The occupant when seated with his back against the back section can safely back-tilt the chair.

9 Claims, 3 Drawing Sheets

MULTI-FUNCTIONAL CAFE CHAIR

BACKGROUND OF INVENTION

1. Field of Invention

This invention relates generally to chairs having a seat, legs and a back, and more particularly to a cafe chair that is multi-functional, making it possible for a seated occupant to use the chair in various modes.

2. Status of Prior Art

The term cafe refers to a coffee house, an informal restaurant or bar. But whether a cafe dispenses coffee, cocktails or sandwiches, it must be furnished by chairs whose appearance and function lend themselves to use in the environment of a cafe. The term cafe chair therefore refers to a chair especially suitable for cafes.

A cafe has no formal arrangement of chairs and tables, for these are deployed to suit changing circumstances. Hence a cafe chair must be light weight and readily movable as well as sturdy. And it must be capable of accommodating itself to the particular use to which it is put by its occupant.

In contradistinction, a dining room chair need not be light weight, nor does it have to be comfortable at any position assumed by its occupant other than the position he takes when seated before a dining room table. This table has a predetermined position in a dining room, and a dining room chair has only one function which is to seat its occupant to face the table.

The appearance and function of a cafe chair are governed by the decor of the cafe in which it is placed. The aesthetics of a cafe and that of its cafe chairs together determine to a significant degree whether a prospective client will be induced to enter the cafe. Thus a cafe whose chairs look like kitchen chairs and whose interior is barn-like will not attract patrons.

In an outdoor cafe, it is mainly the cafe chairs that impart a distinctive character to the cafe. Hence the appearance of these chairs is a major factor in attracting customers.

However, a cafe chair must not only be aesthetically pleasing, but it must also be capable of accommodating the various activities carried out by its occupant in the course of his stay at the cafe. A cafe is not a fast food establishment, for the typical patron tends to linger and in some instances may spend several hours at the cafe. Hence the cafe chair occupied by the patron plays an important role during this stay.

Thus in the course of a stay at a cafe, the occupant of a cafe chair may wish to change his position to observe other people within the cafe or those sauntering in the outside street. And he may wish to engage in conversation a person at a nearby table without leaving his chair. Or he may wish to tilt back the chair so as to address a person standing before him, or as a form of exercise. And at other times the occupant may wish to reverse his position on the chair so that he faces the back of the chair in order to carry out a conversation with a person behind him.

An ideal cafe chair must therefore not only be strong and durable, but it must also be capable of functioning in various modes of operation, such as those described above.

And not only must the cafe chair be light in weight and readily movable, but must also be aesthetically pleasing, thereby welcoming its occupant.

Cafes have a long heritage, for those in Paris, London and Vienna trace their history back to the Middle Ages. Coffee houses are now endemic in the United States, each of the major American cities having hundreds of such houses. And cafe bars continue to proliferate.

In the course of time, many species of cafe chairs have been developed, some now having the status of classics, among which are the Rattan French cafe chair in which bamboo rods are combined with woven rattan, and the Thonet Bentwood chair based on the patented Thonet process for steaming and bending wood. Both of these classic chairs are highly attractive, light weight and easily movable.

But classic cafe chairs as well as others in common use are somewhat are limited in regard to the various ways in which they can be put to use. Thus the Thonet chair which has side arms cannot be used in a reverse mode with its occupant facing backwards.

Nor can many other four legged cafe chairs be comfortably used in a reverse mode, for while in a direct mode, the occupant's legs are in front of the chair and can be close together, in the reverse mode the structure of the chair may be such that the occupant's legs are then uncomfortably far apart and stick out to create a hazard in a crowded cafe.

A cafe chair in accordance with the invention has a sculptured back which suggests a primitive fertility figure. Of prior art interest therefore is Cycladic art originating in the bronze age in the Aegean Cycladic islands. This art takes the form of fertility figures that are frontal and geometric in style.

A typical Cycladic figure is a flat form contoured to define an enlarged ovoid head merging with a body region having outwardly swelling hips from which extend a spaced pair of legs. Similar fertility figures are found in primitive African art and in other cultures. These figures have greatly influenced modern artists, such as Picasso, some of whose paintings and sculptures are reflective of Cycladic or African art.

SUMMARY OF INVENTION

In view of the foregoing, the main object of this invention is to provide a light-weight, readily movable cafe chair that is multi-functional and therefore useable by its occupant in various modes.

A significant feature of the invention resides in the striking aesthetic appeal of the cafe chair, for its appearance is dominated by a back section in the form of a sculptured panel whose contoured shape defines the rear legs of the chair as well as its back rest, yet suggests a fertility figure. Thus a group of cafe chairs may be provided, each have a differently sculptured back section, whereby when these chairs are deployed in a cafe, one then has, as it were, an art gallery of fertility figures.

More particularly, an object of this invention is to provide a cafe chair whose structure makes it possible to operate the chair in a direct mode in which the occupant faces forwardly, a reverse mode in which the occupant faces rearwardly, and in a tilt mode in which the chair is back tilted by its occupant. The chair can also be operated in askew modes.

Also an object of the invention is to provide a chair having relatively few components that are easily assembled, whereby the chair can be mass-produced at relatively low cost.

Briefly stated, these objects are attained by a readily movable cafe chair that is multi-functional and therefore useable by its seated occupant in various ways. The chair includes a back section formed by a sculptured panel defining a flat figure whose head merges with a body region having outwardly swelling hips from which extend widely spaced legs between which is a crotch zone. Joined to the back section is a front section having a lobe-shaped seat whose front end is supported by a pair of front legs which are spaced from the rear legs and are coupled thereto by a fork.

The arcuate rear end of the seat is attached at its apex to the crotch zone of the back section. The sides of the lobe-shaped seat curve inwardly toward the crotch zone to create free spaces adjacent the rear legs of the chair. Thus the occupant may seat himself in a direct mode facing forwardly with his legs in front of the chair legs, or in a reverse mode facing rearwardly with his legs then in the free spaces of the chair. Or the occupant, when seated with his back against the back section, can in a tilting mode then safely back-tilt the chair.

BRIEF DESCRIPTION OF DRAWINGS

For a better understanding of the invention, as well as other objects and features thereof, reference is made to the accompanying drawings wherein.

DESCRIPTION OF DRAWING

First Embodiment

Figure 1:
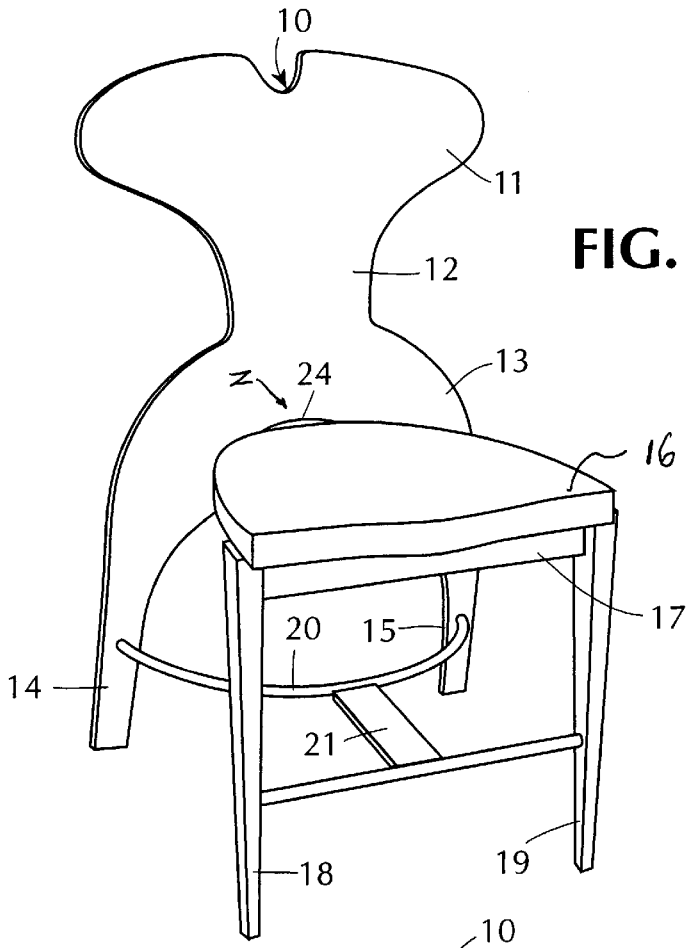
FIG. 1 is a prospective view of a preferred embodiment of a cafe chair.

FIG. 1 illustrates a preferred embodiment of a cafe chair in accordance with the invention that includes a back section generally identified by reference numeral 10. Back section 10 is formed by a sculptural panel of plywood or other high-strength material, such as a fiberglass-reinforced resin panel, the panel being contoured to define an abstract figure which may be similar to a Cycladic fertility figure.

Thus the figure formed by panel 10 has an ovoid head 11 which merges with body region 12 having outswelling hips 13 from which extend a pair of widely space legs 14 and 16.

Legs 14 and 15 of this figure form the rear legs of the chair, and the body region 12 the back rest of the chair which is engaged by the back of the occupant. The panel from which the flat figure is formed is slightly convex so that the back rest of the chair is not straight but curves gently away from the vertical axis.

The nature of the cafe chair structure is such that the sculptured back section is the dominant aesthetic component, for even when seen from the front of the chair, the front section which is joined to the rear section is so placed that it does not obscure the back section almost all of which remains visible to an observer.

Figure 5:
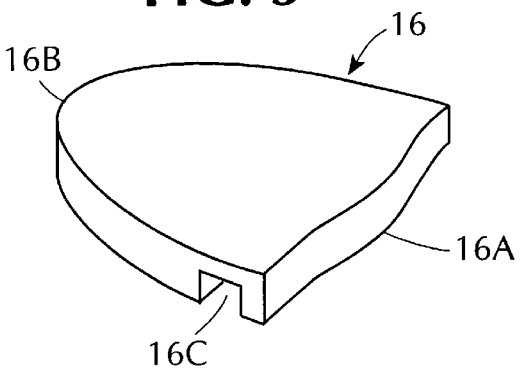
FIG. 5 is a separate view of the lobe-shaped seat of the chair.
Figure 7:
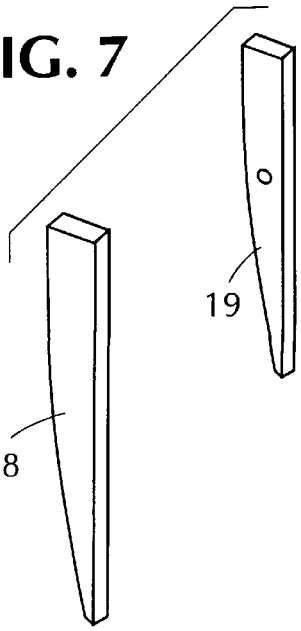
FIG. 7 shows the front legs of the chair.
Figure 8:
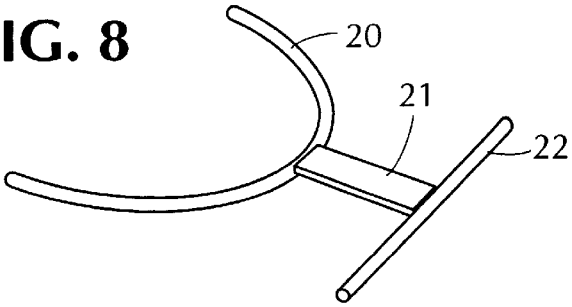
FIG. 8 shows the fork by which the front legs of the chair are joined to the rear legs.

The front section joined to back section 10 includes a lobe-shaped seat 16. As best seen in FIG. 5, seat 16 has a straight front end 16A having a central bulge so that the legs of the occupant of the seat are on either side of the bulge. The opposing sides of the lobe-shaped seat curve inwardly from the front end toward a peak 16B at the rear arcuate end of the seat.

Parallel to front end 16A of the seat is a transverse channel 16C on which is received a cross piece 17 having attached to its end the front legs 18 and 19 of the chair. All components of the front section of the chair are preferably made of high grade wood. Front legs 18 and 19 are coupled to rear legs 14 and 15 of the chair by a metal fork consisting of a U-shaped rod 20 whose midsection is joined to the midsection of a straight rod 22 by a metal slat 21. The ends of curved rod 20 are joined to rear legs 14 and 15, thereby bridging these legs, the front legs 18 and 19 being bridged by straight rod 22. The fork therefore serves to stabilize the chair structure without however blocking the free space between the front and rear legs as would be the case had the front legs been bridged to the rear legs by straight pieces as in a conventional four-legged chair.

Figure 4:
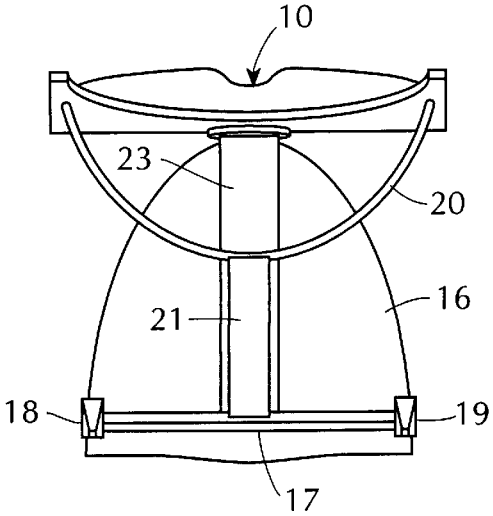
FIG. 4 is a bottom view of the chair.
Figure 6:
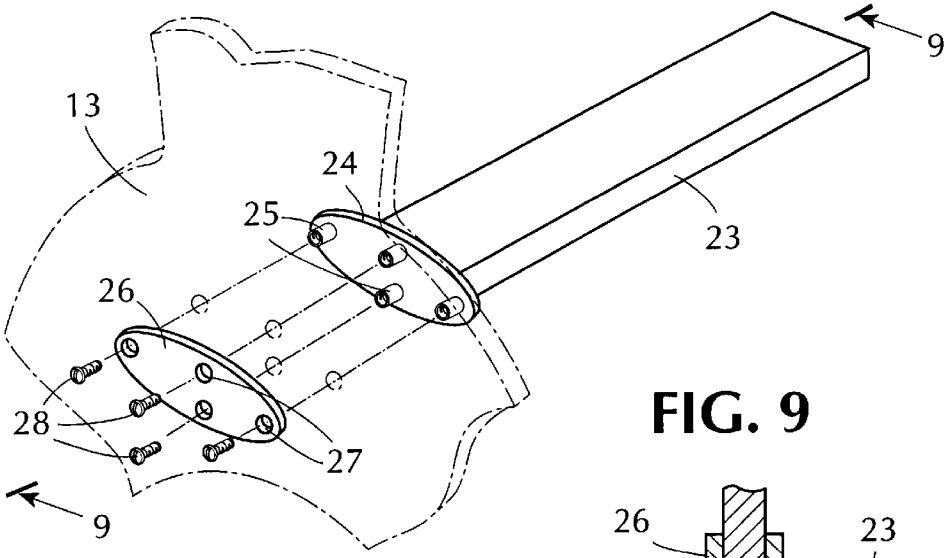
FIG. 6 shows the beam assembly for joining the seat of the chair to the crotch zone of the back section.

Peak 16B at the arcuate rear end of the lobe shaped seat 16 is securely coupled to a crotch zone Z between rear legs 15 and 15 of back section 10 by a beam assembly. As shown in FIGS. 4 and 6, this assembly includes a beam 23 having a rectangular cross section that fits snugly into a longitudinal groove in the underside of seat 16 and is screwed or otherwise attached thereto.

Figure 9:
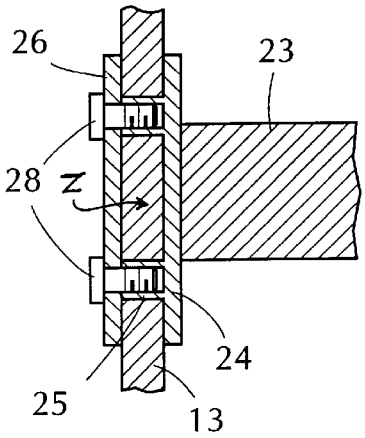
FIG. 9 illustrates how the back section is joined to the seat of the front section.

Connected to the outer end of beam 22 is an oval metal mounting plate 24. Projecting from this plate are four internally-threaded sleeves 25 placed at the corners of a geometric diamond. As shown in FIG. 9, projecting sleeves 25 are inserted in correspondingly positioned bores in crotch zone Z of back section 10.

To clamp beam 23 to crotch zone Z, an oval-shaped metal locking plate 26 is provided having holes 27 therein at positions corresponding to the bores in the crotch zone. Screws 28 inserted in holes 27 of locking plate 26 are threadably received in sleeves 26 projected into the bores in the crotch zone.

Thus back section 10 is securely joined to the seat of the front section at three points at the corners of an isosceles triangle, one being the crotch zone at the peak of the triangle, the other two being at the rear legs 14 and 15.

It is important to note that because the lobe-shaped seat 16 of the front section of the chair curves inwardly toward the crotch zone of back section 10, this creates a free space on either side of the seat adjacent the legs of the back section.

Hence in a reverse mode of operation in which the occupant of the seat faces the back of the chair, his legs are then comfortably accommodated by these free spaces. And should the occupant of the chair when in a normal direct mode faces forwardly, he can then back tilt the chair about the rear legs without however rendering it unstable, for the rear legs are more widely spaced apart than the front legs.

Also because of the free spaces between the back section of the chair and the rear end of the lobe-shaped seat, an occupant of the chair can sit sideways thereon in an askew mode with one leg in a free space and the other leg near one front leg of the chair.

Hence the structure of the chair affords its occupant a high degree of maneuverability and thereby satisfies the special requirements for a chair placed in a cafe setting in which the chair in effect acts as the occupant's action station from which he participates in the drama of cafe activity.

Other Embodiments

In a chair in accordance with the invention its appearance is dominated by the sculptured back section, for the figurative form of this section is seen regardless of the direction in which it is viewed.

Figure 2:
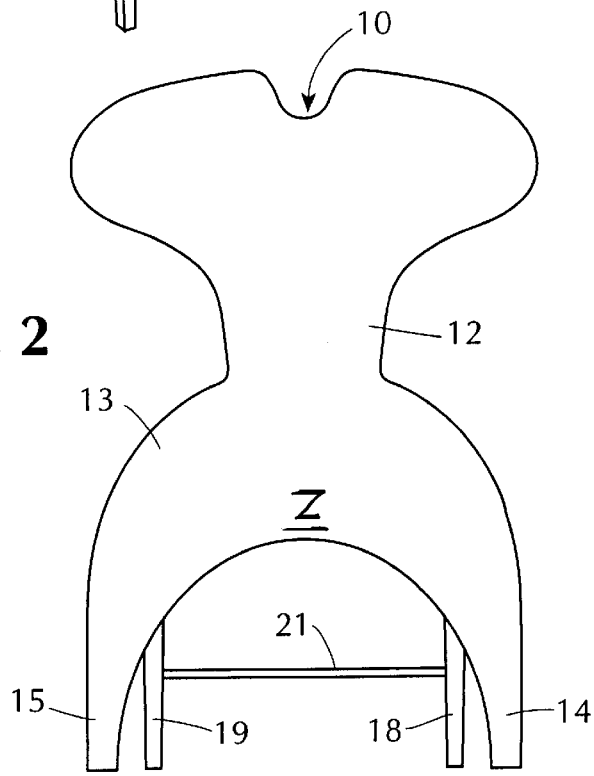
FIG. 2 is a rear view of the chair shown in FIG. 1.
Figure 3:
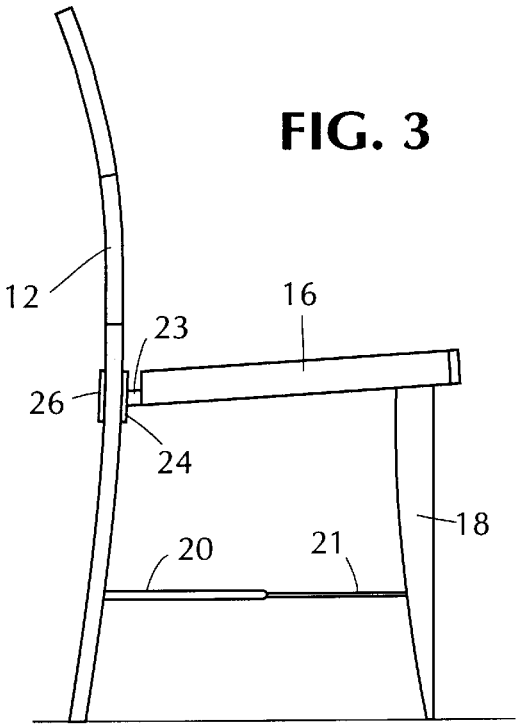
FIG. 3 is a side view of the chair.
Figure 10:
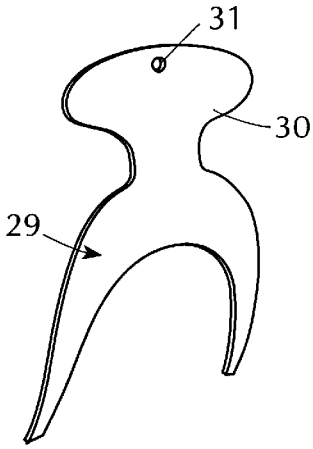
FIG. 10 shows the back section of a second embodiment of the cafe chair.

The chair structure is therefore not limited to the particular sculptured form of the back section shown in FIGS. 1 and 2. Thus the back section of the chair 29 may take the form shown in FIG. 10 in which back section 30 has an ovoid head that is provided with a hole 31, the figure otherwise being similar to that in FIGS. 1 and 2.

Figure 11:
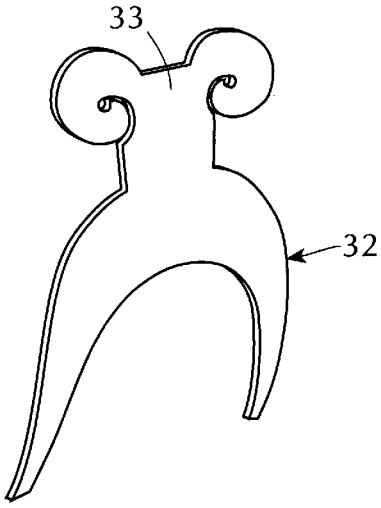
FIG. 11 illustrates the back section of a third embodiment.
Figure 12:
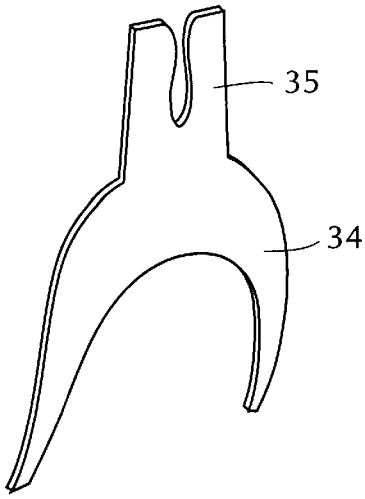
FIG. 12 illustrates the back section of a fourth embodiment.

In the back section 32 shown in FIG. 11, head 33 is provided with a pair of spiraled ears, whereas in back section 34 shown in FIG. 12 head 35 has a longitudinal slot.

In all of the figurative forms created by the sculptured back section, the figures are abstract in nature rather than representational and therefore only suggestive of primitive fertility figures.

While there has been shown and described preferred embodiments of a multi-functional cafe chair in accordance with the invention, it will be appreciated that many changes may be made thereon without departing from the spirit of the invention.

I claim:

1. A cafe chair comprising:

A. a back section constituted by a contoured panel defining a flat figurative form that includes an ovoid head that merges with a body region having outwardly swelling hips from which extend a pair of widely-spaced legs between a crotch zone, the legs acting as rear legs of the chair and the body region as a back rest; and B. a front section including a lobe-shaped seat having a generally-straight front end supported on a pair of front legs spaced from the rear legs of the chair, said seat having an arcuate rear end coupled at its center to the crotch zone to connect the front section to the back section, said lobe-shaped seat having inwardly curved opposing sides extending from the generally-straight front end to the center of said arcuate rear end to create between the curved sides and the rear legs free spaces adjacent said rear legs, whereby an occupant of the chair in a direct mode of use is seated to face in a forward direction with his legs in front of the front legs, and in a reverse mode of use the occupant is seated rearwardly with his legs then in the free spaces adjacent said rear legs.

2. A cafe chair as set forth in claim 1, in which the sculptured panel simulates the form of a fertility figure.

3. A cafe chair as set forth in claim 1, in which the panel is formed of plywood and has a slightly convex shape so that the back rest curves away from a vertical axis.

4. A cafe chair as set forth in claim 1, further includes a fork for interconnecting the front legs of the chair to the rear legs to stabilize the structure of the chair.

5. A cafe chair as set forth in claim 4, in which the fork consists of an arcuate rod whose ends are joined to the pair of rear legs to bridge the legs, a straight rod whose ends are joined to the pair of front legs to bridge the legs, and a slat forming a bridge between the arcuate rod and the straight rod at their midpoints.

6. A cafe chair as set forth in claim 5, in which said arcuate rod, said straight rod and said slat are all made of high-strength light weight metal.

7. A cafe chair as set forth in claim 1, in which clamping means join the arcuate rear end of the seat to the crotch zone of the back section.

8. A cafe chair as set forth in claim 7, in which the clamping means comprise a beam secured to the underside of the seat, a mounting plate attached to the end of the beam provided with at least one projecting internally-threaded sleeve, said sleeve being inserted in a bore in said crotch zone, and a clamping plate having a hole therein in which is inserted a screw that is received in the sleeve whereby the back section is then clamped between the mounting plate and the clamping plate.

9. A cafe chair as set forth in claim 8, in which the clamping plate and the mounting plate have identical oval shapes.

* * * * *